United States Patent [19]

Chauvin

[11] Patent Number: 4,926,834

[45] Date of Patent: May 22, 1990

[54] FOLDING CROSSBOW

[76] Inventor: Glenn A. Chauvin, P.O. Box 807, Escatawta, Miss. 39552

[21] Appl. No.: 301,701

[22] Filed: Jan. 26, 1989

[51] Int. Cl.[5] ..... F41B 5/00

[52] U.S. Cl. ..... 124/25; 124/35.1; 124/44.5

[58] Field of Search ..... 124/25, 24 R, 23 R, 124/24 A, 35 R, 41 A, 86, 88, 87, DIG. 1; 33/265

[56] References Cited

U.S. PATENT DOCUMENTS

| | | | |
|---|---|---|---|
| 2,500,509 | 3/1950 | Bailey . | |
| 2,842,114 | 7/1958 | Duncan . | |
| 3,537,439 | 11/1970 | Joslin | 124/24 R |
| 3,739,765 | 6/1973 | Moore | 124/25 |
| 3,783,852 | 1/1974 | Shepherd . | |
| 3,874,359 | 4/1975 | Cesin . | |
| 4,206,740 | 6/1980 | Lydon . | |
| 4,258,689 | 3/1981 | Barnett . | |
| 4,282,850 | 8/1981 | Warnicke . | |
| 4,545,358 | 10/1985 | Collins . | |
| 4,649,891 | 3/1987 | Bozek . | |
| 4,662,345 | 5/1987 | Stephens | 124/25 |
| 4,688,539 | 8/1987 | Lawrence | 124/DIG. 1 X |
| 4,699,117 | 10/1987 | Waiser . | |
| 4,722,318 | 2/1988 | Yankey | 124/41 A X |
| 4,796,598 | 1/1989 | Jones | 124/41 A X |

*Primary Examiner*—Randolph A. Reese

*Assistant Examiner*—Peter M. Cuomo

*Attorney, Agent, or Firm*—Fleit, Jacobson, Cohn, Price, Holman & Stern

[57] ABSTRACT

The crossbow of the claimed invention comprises a main stock and a secondary stock pivotally connected to the main stock and movable relative to the main stock between collapsed and extended positions. A pair of prod members, each having inner and outer ends, are pivotally connected at the inner ends thereof to the main stock. The prod members are pivotable relative to the main stock between inoperative and operative positions. A drawstring is secured at opposite ends to the prod members, and a drive block is movable along the main stock between cocked and released positions. The drawstring biases the drive block toward the released position. A trigger for retaining the drive block in the cocked position is provided so that when the prod members are in the operative position, an arrow can be loaded onto the crossbow. The trigger is also able to release the drive block from the cocked position so that the drawstring can move the drive block along the main stock toward the released position to fire the arrow. Through the use of such a crossbow construction, the main stock and the secondary stock can be retained in the collapsed position, and the prod members can be retained in the inoperative position when the crossbow is not in use, so that the crossbow is compact and easy to transport.

9 Claims, 3 Drawing Sheets

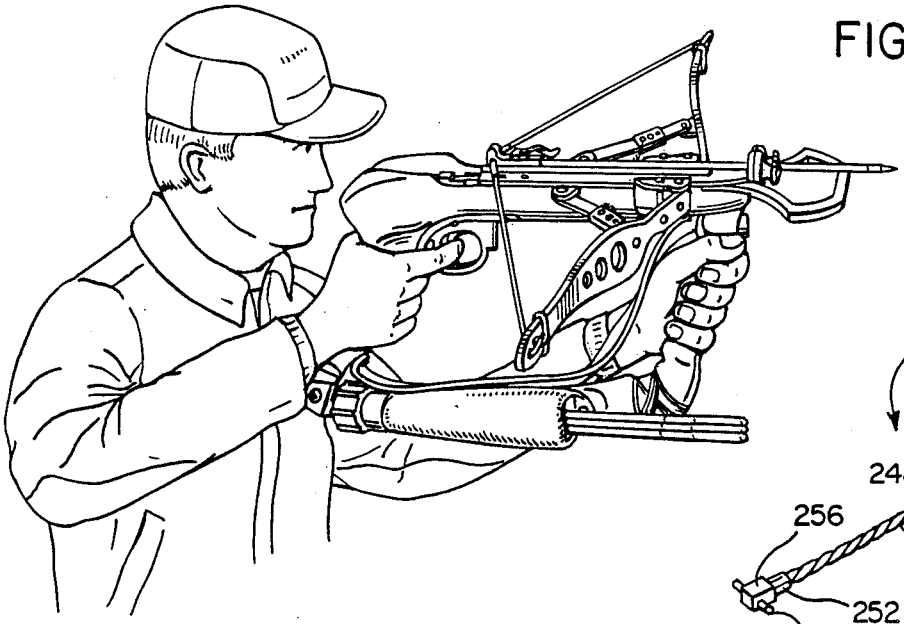
FIG. 1
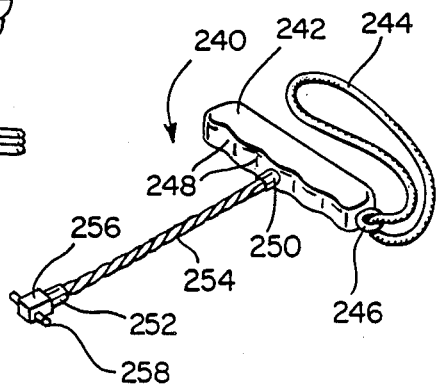
FIG. 9
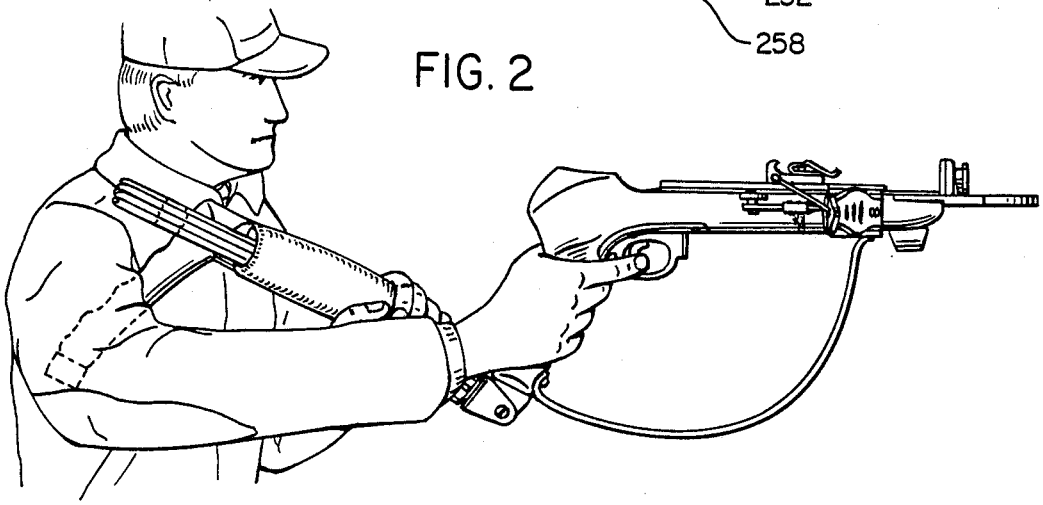
FIG. 2
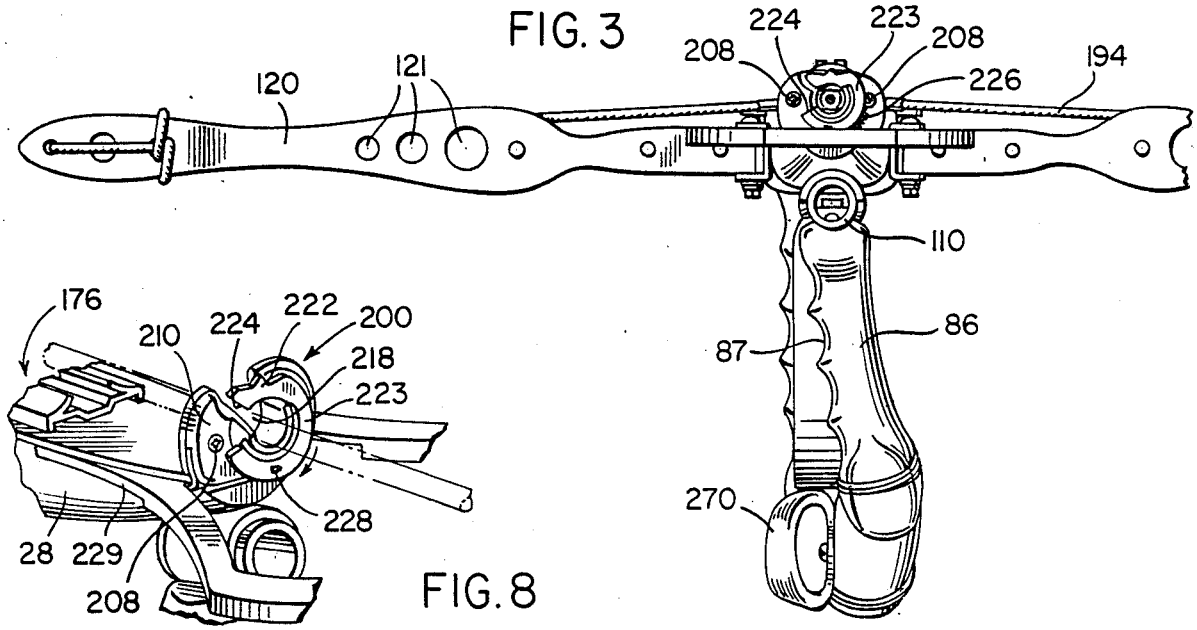
FIG. 3
FIG. 8

FIG. 6
FIG. 4
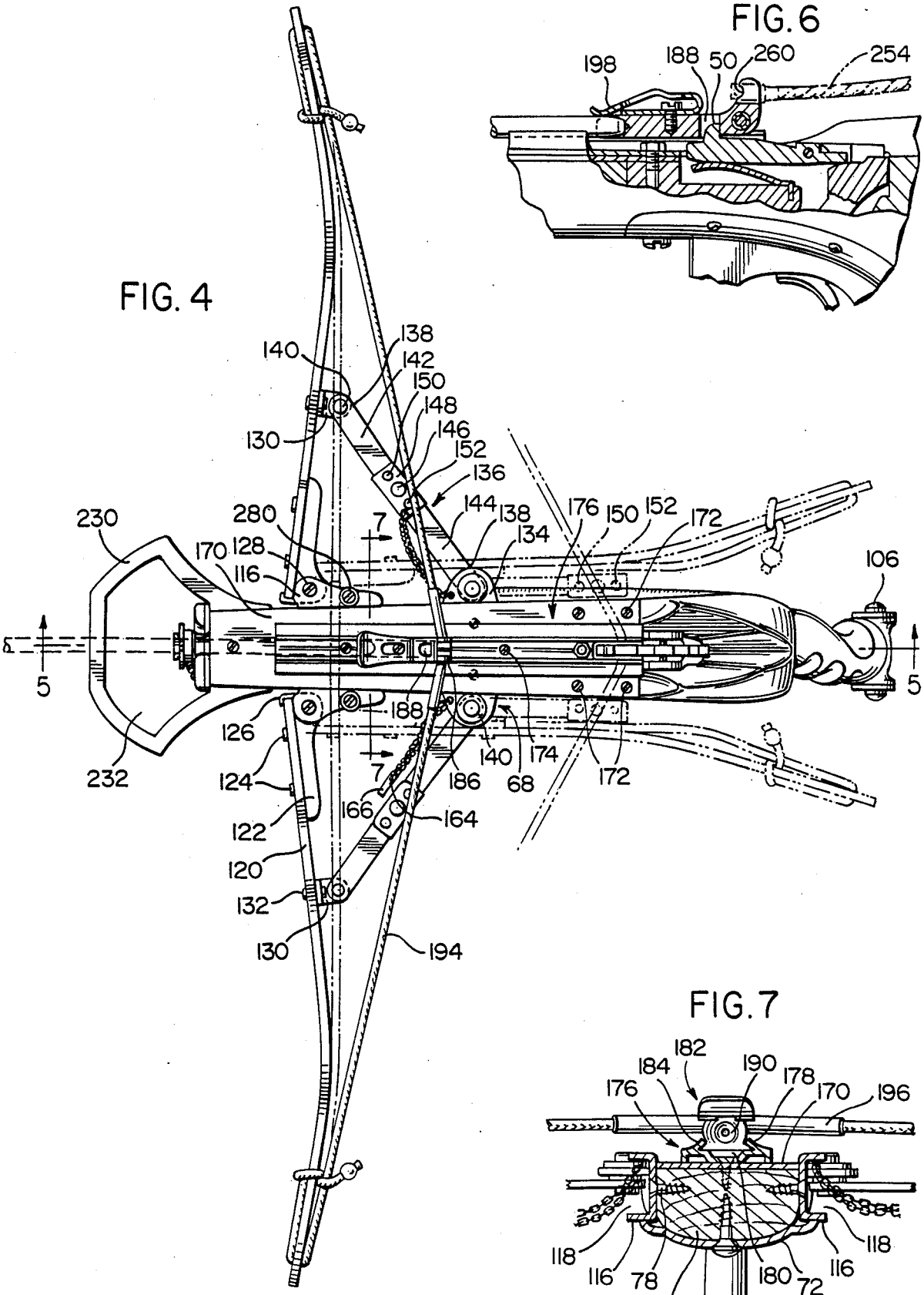
FIG. 7
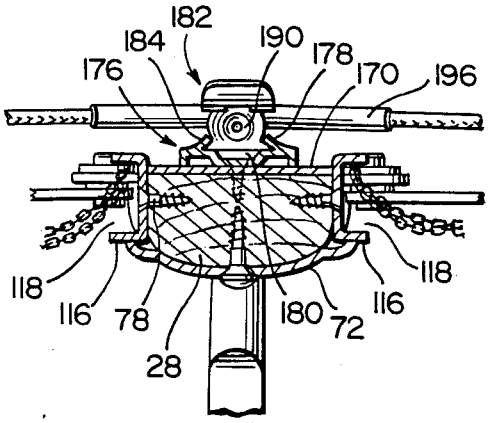

FOLDING CROSSBOW

BACKGROUND OF THE INVENTION

I. Field of the Invention

Crossbows are generally known as medieval weapons from which arrows or stones are fired and which include a bow typically fixed transversely on a stock.

II. Description of Related Art

U S. Pat. No. 4,258,469 to Barnett discloses a crossbow including a one-piece, flexible bow prod secured to a stock. The stock includes a butt, pivotally connected with a fore end portion of the stock, by which the crossbow can be cocked. When the bow is to be cocked, the butt is pivoted about an axis and hooks which are connected to the butt engage the string of the crossbow and draw the string rearwardly along the upper surface of the crossbow towards a catch located at a rearward portion of the crossbow.

U.S. Pat. No. 4,699,117 to Waiser discloses a crossbow including a bow prod with two symmetrical halves mounted on symmetrical mounts. The bow prod mounts are pivotally mounted on a fore end portion of a crossbow stock and are connected to a movable slide. When the crossbow is being cocked, as one of the mounts is turned clockwise by a certain angle, the other is turned counter clockwise by the same angle, to increase the distance between the ends of the bow prod halves to which the bow string is attached and to thereby increase bow prod tension for shooting.

Each of the above crossbow devices could be considered cumbersome to transport and are usable by an operator in only one operating, or firing, position. Additionally, neither of these patents discloses means to significantly aid an operator in aiming the crossbow towards a target.

It is accordingly one object of the present invention to provide a crossbow which is easy to transport and which may be fired in one of several positions. The crossbow thus includes main and secondary stocks which can be moved between collapsed and extended positions, and prod members which can be moved relative to the main stock between inoperative and operative positions.

It is another object of the present invention to provide a sight which significantly aids an operator in aiming the crossbow at a target and yet which allows an arrow to be easily loaded onto the crossbow.

SUMMARY OF THE INVENTION

Both of the above objects, among others, are achieved through the use of a crossbow according to the present invention. The crossbow comprises a main stock and a secondary stock pivotally connected to the main stock and movable relative to the main stock between collapsed and extended positions. A pair of prod members, each having inner and outer ends, are pivotally connected at the inner ends thereof to the main stock. The prod members are pivotable relative to the main stock between inoperative and operative positions. A drawstring is secured at opposite ends to the prod members, and a drive block is movable along the main stock between cocked and released positions. The drawstring biases the drive block toward the released position. A trigger for retaining the drive block in the cocked position is provided so that when the prod members are in the operative position, an arrow can be loaded onto the crossbow. The trigger is also able to release the drive block from the cocked position so that the drawstring can move the drive block along the main stock toward the released position to fire the arrow. Through the use of such a crossbow construction, the main stock and the secondary stock can be retained in the collapsed position and the prod members can be retained in the inoperative position when the crossbow is not in use, so that the crossbow is compact and easy to transport.

BRIEF DESCRIPTION OF THE DRAWINGS

FIG. 1 is a perspective view of the crossbow just prior to firing, and in which the crossbow main and secondary stocks are illustrated in a collapsed position.

FIG. 2 is a side view of the crossbow just after firing, and in which the crossbow main and secondary stocks are illustrated in an extended position.

FIG. 3 is a front view of the crossbow, illustrating the prod members of the crossbow in an operative position.

FIG. 4 is a top plan view of the crossbow.

FIG. 6 is an enlarged side view of the crossbow drive block, showing the manner in which the crossbow is cocked.

FIG. 7 is a sectional view along line 7—7 of FIG. 4.

FIG. 8 is an enlarged perspective view of the crossbow arrow guide sight.

FIG. 9 is a perspective view of a cocking device used in conjunction with the crossbow.

DESCRIPTION OF THE PREFERRED EMBODIMENT

Figure 5:
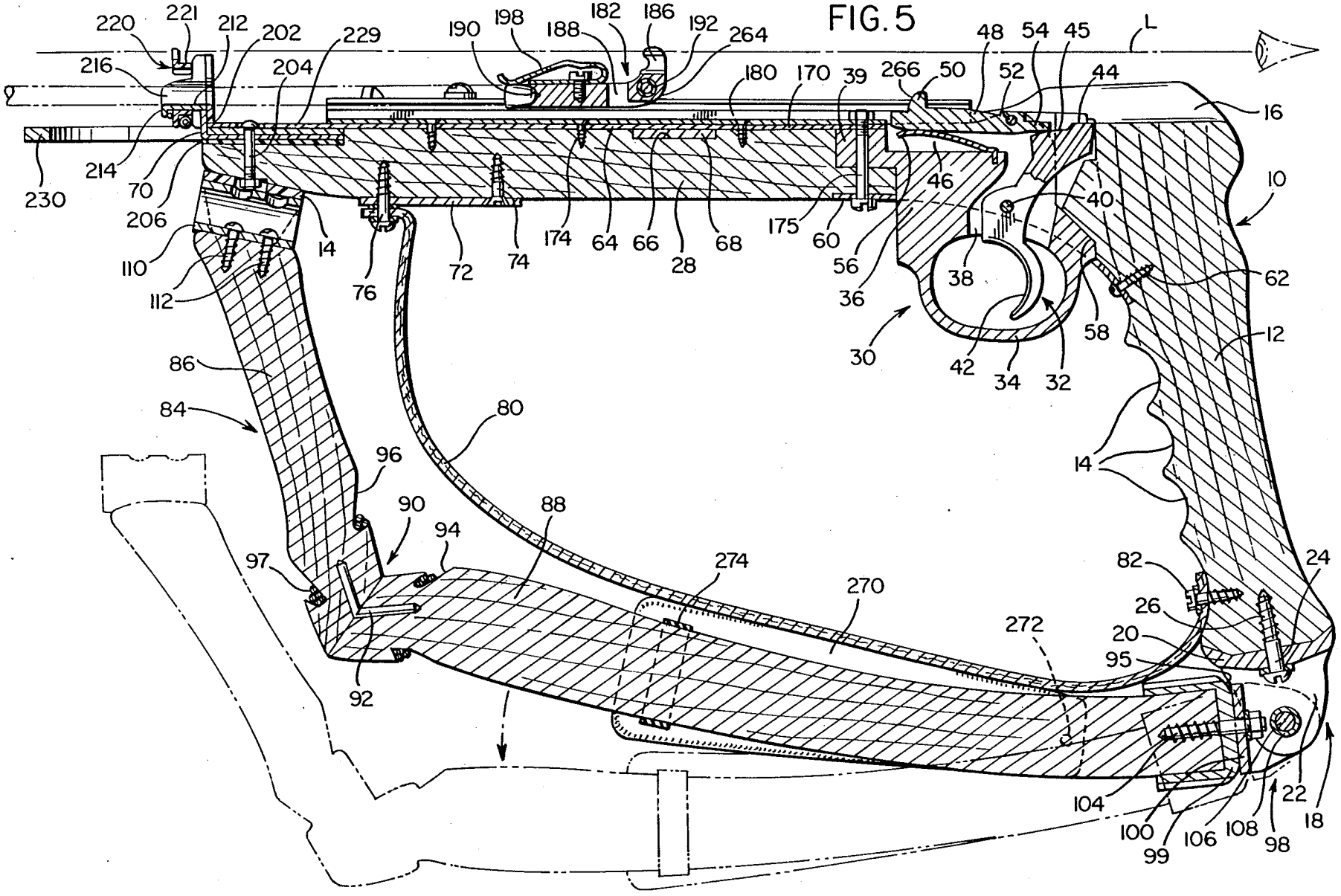
FIG. 5 is a sectional view along line 5—5 of FIG. 4.

Referring now primarily to FIG. 5, reference number 10 indicates generally a main stock of the crossbow including a pistol grip portion 12. Pistol grip portion 12 is provided with finger receiving recesses 14. A sighting recess 16 is cut out from a first, upper end of pistol grip portion 12. At a second end of pistol grip portion 12 opposite the sighting recess, a first substantially U-shaped hinge bracket 18 is fixed. Hinge bracket 18 includes base portion 20 and upstanding side portions 22 at opposite sides of base portion 20. Base portion 20 is formed with a central aperture 24 through which a screw 26 is passed to rigidly secure hinge bracket 18 to the lower end of grip portion 12.

In addition to pistol grip portion 12, main stock 10 includes a fore end portion 28. A trigger assembly, generally designated 30 and shown in section, is installed in the fore end portion. A trigger 32 and a finger guard 34 are provided, the finger guard 34 being integrally formed with a trigger assembly block 36. Trigger 32 is affixed within a through going aperture 38 formed in the trigger assembly block. A pin 40 extends transversely within aperture 38 between side walls of the aperture.

Trigger 32 is pivotally mounted in aperture 38 about pin 40 so that when pressure is applied to finger receiving portion 42 of trigger 32, the trigger 32 pivots. At a side of pin 40 opposite finger receiving portion 42, an actuating block portion 44, which includes a cam surface 45, is provided on trigger 32 and extends upwardly within the aperture 38. The aperture 38 opens into a forwardly extending recess 46. A catch 48 pivots within recess 46 as trigger 32 is moved by an operator. The catch is provided with an upstanding tooth 50 and a flange 54, which engages cam surface 45. Tooth 50 and flange 54 are disposed at opposite sides of a second pin 52, about which catch 48 pivots. Pin 52 extends transversely within the aperture 38.

Leaf spring 56 is press fit or otherwise fixedly secured in recess 46 of trigger assembly body 36 and extends upwardly and forwardly within recess 46 into engagement with an underside of catch 48. Leaf spring 56 biases the portion of pivoting catch 46 including tooth 50 clockwise about pin 52 as illustrated in FIG. 5 and outwardly of recess 46.

Trigger assembly cut out 58 is formed in that end of fore end portion 28 adjacent pistol grip portion 12 of main stock 10. Cut out 58 receives the trigger assembly block 36 of the trigger assembly. A cover plate 60 is fixed to the main stock 10 about the underside of opening 58 by screws 62 to provide an attractive appearance and to protect the trigger assembly.

The fore end portion 28 of main stock 10 is provided with a flat upper surface 64. A cut out 66 is provided in the flat upper surface 64 and receives a prod lock pivot brace 68, which will be described shortly. A second cut out 70 for receiving a front arrow guide sight, which also will be described shortly, is provided at the end of fore end portion 28 opposite to pistol grip portion 12. A prod hinge pin bracket 72 is fixed to the underside of portion 28 by a first screw 74, a second screw 76 and side screws 78. Shoulder strap 80, preferably of leather, extends between the second screw 76 and a screw 82 secured adjacent the second end of pistol grip portion 12.

A secondary stock is generally designated by reference number 84. As will become apparent, secondary stock 84 is pivotally connected to main stock 10 and movable relative to the main stock between collapsed and extended positions. The secondary stock 84 includes a shoulder abutting portion 86 and a longitudinally extending portion 88. Shoulder abutting portion 86 may be provided with finger receiving recesses 87, visible in FIG. 3. Portions 86 and 88 are rigidly joined together at an elbow joint 90. An angled reinforcing pin 92 may be driven into adjacent ends of portions 86 and 88 to assure proper alignment of the portions. Near their adjacent ends, moreover, portions 86 and 88 may be provided with circumferentially extending grooves 94 and 96 for receiving a reinforcing cable 97 wrapped about elbow joint 90 in the manner shown in FIGS. 1 and 5. Cable 97 is provided to assure the integrity and reinforce elbow joint 90. Cable 97 may be coated with epoxy material for additional strength.

An end cap 99 is provided on a second end of longitudinally extending portion 88 opposite elbow joint 90. End cap 99 is fitted over the second end of portion 88 and provides a bearing surface 95 against which a second substantially U-shaped hinge bracket 98 abuts. Bracket 98 is similar to the first substantially U-shaped hinge bracket 18 and includes base portion 100 and upstanding side portions 102. Side portions 102 are set slightly further apart than side portions 22 so that side portions 22 may be received within side portions 102. A screw 104 is passed through aligned central apertures in base portion 100 and cap 99 to secure the base portion and the cap to the second end of longitudinally extending portion 88.

Side portions 22 and 102 are each provided with an aperture. When side portions 22 are received within side portions 102, the apertures are aligned, and a pivot pin 106 is passed through and secured within the aligned apertures. A spacing sleeve 108 may be provided about the exterior of the pivot pin to reinforce side portions 22.

A tubular connecting element 110 is secured by screws 112 to that end of secondary stock portion 86 opposite elbow joint 90. A plastic C-shaped receiving member 114 is secured by screws (not shown) to the underside of main stock fore end portion 28 and is located so that it is aligned with element 110 as shown in FIG. 5. The sides of C-shaped receiving member 114 are dimensioned so that tubular connecting element 110 is movable into and out of snap fit engagement with the receiving member sides.

FIG. 4 shows a top view of the main stock 10 illustrated in section in FIG. 5. As FIGS. 4 and 7 show, the prod hinge bracket 72 includes U-shaped channel members 116 integrally formed with the prod hinge bracket. Channel members 116 each include an open recess 118 which opens in a lateral direction away from the fore end portion 28, as is most clearly shown in FIG. 7.

A pair of prod members 120 are pivotally connected at inner ends by means of the U-shaped channel members 116 to the main stock fore end portion 28. Voids 121 may be provided in prod members 120 to reduce the weight thereof, if desired. A pivot block 122 is secured by rivets 124 to the inner end of each prod member. Pivot block 122 includes a flange 126 at one end thereof against which the innermost end of a prod member 120 can abut prior to riveting in order to assure proper positioning of the pivot block on each prod member 120.

Pivot blocks 122, also formed as channel members, are dimensioned to fit within recesses 118 of each channel member 116. Each pivot block 122 is formed with an aperture (not indicated), adjacent the inner end of its associated prod member, which can be aligned with corresponding apertures in the sides of a channel member 116. A pivot element 128, such as pin or screw, is passed through these aligned apertures and secured within the apertures in conventional fashion. Prod members 120 are thus each pivotable about the pivot elements 128 relative to main stock 10.

An L-shaped bracket 130 is secured by a rivet 132 to each prod member. Brackets 130 are located approximately a third of the way along the length of each prod member away from the innermost prod member end.

As is most readily apparent from FIG. 4, prod lock pivot brace 68 is formed with ears 134 extending laterally relative to fore and portion 28 and located at opposite sides of the fore end portion. A link member, designated generally by reference number 136, extends between each L-shaped bracket 130 and one of the ears 134. Ends 138 of each link member are secured by rivets 140 or other appropriate pivot elements to a bracket 130 and to one of the ears 134 so that a link member extends between each prod member and the main stock.

Each link member includes a pair of links 142 and 144. Links 142 and 144 are pivotally joined at their adjacent ends by a pivot 146 formed by a rivet or the like. The end of link 142 including pivot 146 is formed by a folded over piece 148 of the link. Piece 148, when folded over, forms sides between which a channel is formed. Within the channel, the end of link 144 is received. Piece 148 includes first holes 150 and second holes 152 passing therethrough. Holes 150 and 152 are drilled or otherwise formed at opposite sides of the pivot 146 from each other.

When the folding crossbow is not being used, i.e. when the crossbow is being stored or transported, prod members 120 are located in an inoperative position adjacent main stock 10, shown in phantom in FIG. 4. Prod members 120 are pivoted for use about elements 128 into an operative position illustrated in solid lines in FIG. 4. As the prod members 120 are pivoted from the inoperative to the operative position, links 142 and 144 pivot relative to the prod members and to ears 134, respectively, as well as relative to each other. Links 144 include holes (not shown) drilled therein near the location of pivots 146. The holes in links 144 align with holes 150 when prod members 120 are in the inoperative position and align with holes 152 when the prod members are in the operative position.

A chain 160 is looped through a small hole 162 in each ear 134 and through a hole 164 in an end of a pin 166. Chains 160 secure pins 166 to ears 134 and prevent the pins from being lost. Pins 166 are dimensioned to pass through the holes in links 144 and holes 150 and 152. Each pin 166 may be passed through a hole 150 and an aligned hole in a link 144 to prevent relative movement between links 142 and 144. Thus, a prod member 120 can be locked in its inoperative position. Similarly, when the same prod member is in its operative position, the same pin 166 may be passed through hole 152 and the aligned hole in link 144 to lock the prod member in the operative position.

A layer 170 is superposed on upper surface 64 of main stock portion 28 to cover cut outs 66 and 70 and thereby provide a continuous, flat surface on portion 28. Layer 170 is secured to portion 28 by screws 172, as is most clearly seen in FIG. 4. Affixed on top of layer 170 by screws 174 and bolt 175 is a track 176 which extends along the length of main stock portion 28.

Track 176 is illustrated in cross-section in FIG. 7. It can be seen from FIG. 7 that track 176 is formed with upstanding and converging side flanges 178. Between the flanges 178 is formed a longitudinal guideway 180, extending along portion 28 of main stock 10 and within which a drive block 182 is located. Drive block 182 is formed with laterally extending flanges 184 which interengage with flanges 178. Through the interengagement of flanges 178 and 184, the drive block is constrained so that it moves longitudinally freely along the guideway between cocked and released positions but is retained by flanges 178 within the guideway.

A pair of upstanding ears 186 are formed on a rearward portion of drive block 182. The drive block also includes a vertically extending hole 188, a forwardly opening recess 190 and a horizontally and laterally extending hole 192. Received within the laterally extending hole is central portion of a drawstring 194. Drawstring 194 is knotted or otherwise secured at both of its ends to each outer end of prod members 120. The central portion of drawstring 194 is encased in a flexible plastic or rubber layer 196, which acts as a bearing for the drawstring central portion and prevents the central portion from becoming worn and frayed. It should be clear from the foregoing that drawstring 194 biases drive block 182 toward its released position.

Hole 188 is provided in the drive block to form a catch which cooperates with upstanding tooth 50. Tooth 50 engages in hole 188 so that the drive block 182 can be retained in a cocked position on track 176.

A spring clip 198 is secured by screw 200 to the top of drive block 182. Recess 190 in the drive block receives the rear end of an arrow when the arrow is mounted in the crossbow, as FIG. 5 illustrates. When an arrow is mounted in the crossbow, the end of the spring clip 198 abuts the arrow as shown in FIG. 5. In this way, clip 198 secures the arrow within recess 190 and prevents the arrow from falling out of recess 190 if the user happens to aim the crossbow downwardly.

Referring now to FIGS. 5 and 8, front arrow guide sight 200 is shown as mounted on a front end of fore end portion 28. As will become clear, sight 200 is used both as a sight to aid a user in aiming an arrow and as an arrow alignment device.

Sight 200 is mounted on the crossbow by an L-shaped bracket 202 secured by a bolt 204 within cut out 70. As FIG. 5 shows, layer 170 extends over the cut out 70 and that portion of bracket 202 located within cut out 70 to provide an attractive appearance. A spacer 206 can be provided, if necessary, to fill the cut out 70, and may also be secured within cut out 70 by the bolt 204.

Fastened by screws 208 to an upstanding leg of bracket 202 is a sight base 210. Sight base 210 includes an elongated, cylindrical extension 212. Extension 212 is integrally formed with or rigidly secured to the sight base and projects forwardly relative to the sight base. The extension is formed with a flange 214 at its front end and is provided at an upper portion of its cylindrical wall 216 with first cut away portion 218.

A C-shaped alignment member 220 is mounted for rotation on extension 212. The alignment member includes an axial sleeve portion 221 disposed around wall 216 and a radial portion 223 having a projection 222 which, as will become clear, is used as an aid in aiming an arrow. Also provided in the alignment member is a second cut away portion 224 which can be manually selectively aligned with cut away portion 218 of cylindrical wall 216. A coil spring 226 is disposed about sleeve portion 221 and has one end secured to one of the screws 208 as shown in FIG. 3 and its other end hooked through a hole 228 provided in radial portion 223 of alignment member 220. Spring 226 acts to bias alignment member 220 to the position illustrated in FIGS. 3 and 8, in which projection 222 is vertically oriented and in direct alignment with the space between upstanding ears 186 on drive block 182. When an arrow has been loaded on the crossbow and the crossbow is about to be used, projection 222 is visually aligned centrally between ears 186 to aim the arrow as a user peers along the line of sight L of FIG. 5. Sighting recess 16 is provided so that the first, upper end of pistol grip position 12 does not interfere with the user's line of sight.

Rigidly secured by bolt 204 within second cut out 70, in addition to arrow guide sight 200, is an extension plate portion 229 of a nose guard 230. Nose guard 230 serves to protect sight 200 from being damaged and also can be used as an aid in cocking the crossbow as will presently be described. As illustrated, nose guard 230 is formed with a void 232.

FIG. 9 illustrates a cocking device 240 which may be used to assist an operator in cocking the crossbow. Device 240 includes a rigid handle 242 provided with a wrist strap 244 passing through a conventional eyelet 246 secured to the rigid handle. Handle 242 is formed with finger grooves 248 at one of its sides and a bore or recess (not indicated) located at the center of the handle. Conventional anchor elements 250 and 252 are provided at both ends of a cable or rope 254. Anchor element 250 is received in the bore or recess and secures rope 254 to handle 242, while anchor element 252 secures the rope to a metal block 256. Protrusions 258 extend laterally from block 256. Protrusions 258 may be formed by ends of a pin passed through block 256 and rigidly secured to the block, for example by soldering or welding, or alternatively, may be integrally formed with the block.

In the disclosed embodiment, both main stock 10 and secondary stock 84 are wood. It should be recognized, however, that stocks 10 and 84 could be made of plastic or any other relatively lightweight and sturdy material. Except for shoulder strap 80, cable 97, member 114, drawstring 194, plastic or rubber layer 196, quiver 270 and strap 274, the remainder of the crossbow is, as disclosed, constructed of suitable metals or metal alloys. It should be recognized, however, that other suitable materials could be used if so desired.

The operation of the crossbow will now be described, assuming the prod members 120 to be initially in the inoperative position illustrated in phantom in FIG. 4. To use the crossbow, an operator manually pivots the prod members about pivot elements 128 from the inoperative position to the operative position, illustrated in solid lines in FIG. 4. As is clear, prior to manually pivoting the prod members in such a way, the operator must first withdraw each pin 166 from its initial position within a hole 150 and the aligned hole in the respective link 144.

As prod members 120 are pivoted into the operative position shown in solid lines in FIG. 4, links 142 and 144 also move relative to each other about pivot 146 until the links are positioned as shown in FIG. 4, with holes 152 aligned with the holes in links 144. Pins 166 may then be inserted through the aligned holes 152 and in links 144 to lock the prod members 120 in the operative position.

After the prod members have been locked in the operative position, the crossbow is ready to be cocked. To cock the device, an operator may grasp the nose guard 230 or, alternatively, insert the toe of his or her shoe into nose guard void 232 to securely anchor the nose guard in position. The operator then inserts one hand through cocking device wrist strap 244 and grasps the rigid handle 242 tightly. Protrusions 258 of the cocking device are then placed into notches 260 formed in drive block ears 186. The operator pulls on handle 242 to retract drive block 182 along track 176 against the force of the drawstring so that the drive block is moved in guideway 180 from an uncocked position, at one end of the guideway adjacent prod members 120, to a cocked position at the opposite end of the guideway. As the drive block approaches the opposite end of guideway 180, curved surface 264 of the drive block engages curved surface 266 of tooth 50. Since drive block 182 is prevented by flanges 178 from moving normally relative to track 176, engagement of surfaces 264 and 266 forces catch 48 to pivot about pin 52 into recess 46 against the bias provided by leaf spring 56. Once the drive block has been moved over the catch a distance sufficient to align hole 188 with tooth 50, the force of spring 56 causes tooth 0 to enter into hole 188, as shown in FIG. 6. In this manner, the tooth 50 retains drive block 182 in its cocked position on track 176. Protrusions 258 of the cocking device 240 are then disengaged from notches 260.

After drive block 182 has been moved to the cocked position, an arrow must then be loaded on the crossbow. To store arrows, a quiver 270 is provided and is secured by at least one screw 272 and a resilient elastomeric strap 274 to secondary stock portion 88 as illustrated in FIG. 5. To load an arrow in the crossbow, it is first withdrawn from quiver 270 and its rearward end placed in drive block recess 190. The C-shaped alignment member 220 is then manually rotated clockwise, viewing FIG. 3, against the force of spring 226 so that cut away portion 224 of the alignment member is aligned with cut away portion 218 of wall 216. The forward end of the arrow may then be lowered vertically through the aligned cut away portions until the arrow shaft rests on wall 216. Alignment member 220 is then released by the operator and rotated counterclockwise, viewing FIG. 3, under the return force applied by spring 226 back into the position illustrated in FIG. 8. The arrow is then loaded and ready to be fired.

To aim the crossbow, as noted previously, the operator centers projection 222 between ears 186 and aligns projection 222 with a target along the line of sight L. Once the crossbow has been properly aimed, trigger 32 is pulled and actuating block portion 44 of the trigger is pivoted counterclockwise, viewing FIG. 5, about pin 52. Cam surface 45 cooperates with flange 54 to drive catch 48 counterclockwise about pin 52, against the bias of leaf spring 56. Tooth 50 is simultaneously withdrawn from hole 188 to release the drive block 182 from the cocked position. The force applied by drawstring 194 on drive block 182 moves the drive block rapidly along guideway 180 toward its released or uncocked position to fire the arrow.

Once firing has been completed, prod members 120 may once again be moved to the inoperative position following withdrawal of pins 166 from holes 152 and the aligned holes in links 144. However, in order to keep drawstring 194 tight when prod members 120 are moved to the inoperative position, the drawstring should be lifted over and forward of stop bolts 280, secured to channel members 116, prior to moving the prod members to the inoperative position, as shown in phantom in FIG. 4.

FIG. 1 illustrates the crossbow being used by an operator while the main stock 10 and secondary stock 84 are in a collapsed position. In the collapsed position, the main and secondary stocks are positioned relative to each other as shown in solid lines in FIG. 5, with tubular connecting element 110 retained in snap fit engagement within C-shaped receiving member 114. As shown, when using the crossbow in this manner, the operator grasps pistol-grip portion 12 with one hand and shoulder abutting portion 86 with the other. The operator may fire the crossbow while in this configuration whenever he or she wishes to use the illustrated two handed grip. Such a two handed grip makes it easy to quickly change the direction in which the crossbow is aimed.

FIG. 2 illustrates the crossbow being used when stocks 10 and 84 are in an extended or shoulder supportable position. To move main stock 10 and secondary stock 84 from the collapsed position to the shoulder supportable position, tubular connecting element IIO is unsnapped from its engagement within member 114 so that secondary stock 84 may be pivoted in the direction indicated by arrow A in FIG. 5 about pin 106. Secondary stock 84 may simultaneously be pivoted relative to hinge bracket 98 about screw 104 until the secondary stock assumes the shoulder supportable position illustrated in FIG. 2. The secondary stock is then grasped by the operator as shown in FIG. 2 to provide a two handed grip for firing. The two handed grip illustrated in FIG. 2 provides a very stable support for the crossbow so that the crossbow can be carefully aimed. After firing, secondary stock 84 can again be pivoted about screw 104 and pin 106 from the extended position back into the collapsed position.

When the crossbow is not in use, shoulder strap 80 may conveniently be used to support the crossbow on the shoulder of an operator for transportation while stocks 10 and 84 of the crossbow are in the collapsed position.

The foregoing should be considered as illustrative only of the principles of the invention. Numerous modifications and changes may occur to those skilled in the art. Accordingly, it is not desired to limit the invention to the exact construction and operation shown and described. Suitable modifications and equivalents may exist which fall within the scope of the invention defined by the appended claims.

I claim:

1. A crossbow comprising:

a main stock, a secondary stock pivotally connected to said main stock and movable relative to said main stock between collapsed and extended positions, a pair of prod members, each having inner and outer ends, said prod members pivotally connected at the inner ends thereof to said main stock and pivotable relative to said main stock between inoperative and operative positions, a drawstring secured at opposite ends to said prod members, a drive block movable along said main stock between cocked and released positions, said drawstring biasing said drive block toward said released position, and a trigger for retaining said drive block in said cocked position so that when said prod members are in said operative position, an arrow can be loaded onto said crossbow, said trigger also able to release said drive block from said cocked position so that said drawstring can move said drive block along said main stock toward said released positon to fire the arrow, wherein said main stock and said secondary stock can be retained in said collapsed position and said prod members can be retained in said inoperative position when the crossbow is not in use so that the crossbow is compact, an arrow guide sight mounted on said main stock, said arrow guide sight comprising an L-shaped bracket secured to said main stock, a sight base, including an elongated cylindrical extension, secured to said bracket, said extension projecting forwardly relative to said sight base and being provided with a first cut away portion in its cylindrical wall, and an alignment member including a second cut away portion, mounted for rotation on said extension, wherein said alignment member can be rotated so that said first and second cut away portions are aligned and an arrow may be lowered through the aligned cut away portions to load said arrow for firing.

2. A crossbow as defined by claim 1, and further comprising a link member secured to and extending between each prod member and said main stock, said link member enabling an operator to lock each prod member both in its operative and inoperative positions.

3. A crossbow as defined by claim 2, and further comprising a pin, wherein each link member comprises a pair of links pivotally joined at adjacent ends, one of said links including a first hole aligned with a hole in the other of said links when said prod members are in said inoperative position and a second hole aligned with said hole in the other of said links when said prod members are in said operative position so that said pin may be passed through aligned holes in said links to lock each prod member in one of said inoperative and operative positions.

4. A crossbow as defined by claim 1, and further comprising stop bolts secured to said main stock, wherein said drawstring can be lifted over and forward of said stop bolts in order to keep said drawstring tight when said prod members are moved to said inoperative position.

5. A crossbow as defined by claim 1, and further comprising a spring clip secured to said drive block, wherein when an arrow is mounted in the crossbow, an end of said spring clip abuts the arrow to secure the arrow to said drive block and prevent the arrow from falling from the crossbow if the crossbow is aimed downwardly.

6. A crossbow as defined by claim 5, and further comprising means to support the crossbow on the shoulder of an operator while said stocks are in one of the collapsed and extended positions.

7. A crossbow comprising:

a main stock, a secondary stock pivotally connected to said main stock and movable relative to said main stock between collapsed and extended positions, a pair of prod members, each having inner and outer ends, said prod members pivotally connected at the inner ends thereof to said main stock and pivotable relative to said main stock between inoperative and operative positions, a drawstring secured at opposite ends to said prod members, a drive block movable along said main stock between cocked and released positons, said drawstring biasing said drive block toward said released position, and a trigger for retaining said drive block in said cocked position so that when said prod members are in said operative position, an arrow can be loaded onto said crossbow, said trigger also able to release said drive block from said cocked position so that said drawstring can move said drive block along said main stock toward said released position to fire the arrow, wherein said main stock and said secondary stock can be retained in said collapsed position and said prod members can be retained in said inoperative position when the crossbow is not in use so that the crossbow is compact, a link member secured to and extending between each prod member and said main stock, said link member enabling an operator to lock each prod member both in its operative and inoperative positions, a pin, each link member comprising a pair of links pivotally joined at adjacent ends, one of said links including a first hole aligned with a hole in the other of said links when said prod members are in said inoperative position and a second hole aligned with said hole in the other of said links when said prod members are in said operative position so that said pin may be passed through alignment holes in said links to lock each prod member in one of said inoperative and operative positions, an arrow guide sight mounted on said main stock, said arrow guide sight comprising an L-shaped bracket secured to said main stock, a sight base, including an elongated cylindrical extension, secured to said bracket, said extension projecting forwardly relative to said sight base and being provided with a first cut away portion in its cylindrical wall, and an alignment member including a second cut away portion, mounted for rotation on said extension, wherein said alignment member can be rotated so that said first and second cut away portions are aligned and an arrow may be lowered through the aligned cut away portions to load said arrow for firing.

8. A crossbow as defined by claim 7, wherein said drive block has a pair of upstanding ears formed thereon and said alignment member includes a projection which is visually aligned by an operator centrally between said upstanding ears to aim said arrow for firing.

9. A crossbow as defined by claim 8, and further comprising a spring to bias said alignment member into a position in which said projection is aligned between said upstanding ears.

* * * * *